US009128401B2

(12) United States Patent
Son et al.

(10) Patent No.: US 9,128,401 B2
(45) Date of Patent: Sep. 8, 2015

(54) IMAGE FORMING APPARATUS TO ENHANCE PRINTING PERFORMANCE AND PRINTING METHOD THEREOF

(71) Applicant: SAMSUNG Electronics Co., Ltd., Suwon-si, Gyeonggi-do (KR)

(72) Inventors: Jung-woo Son, Seoul (KR); Jeong-tae Kim, Incheon (KR); Beom-ro Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/648,345

(22) Filed: Oct. 10, 2012

(65) Prior Publication Data

US 2013/0089353 A1 Apr. 11, 2013

(30) Foreign Application Priority Data

Oct. 10, 2011 (KR) ..... 10-2011-0103050

(51) Int. Cl.

*G03G 21/14* (2006.01)
*G03G 15/01* (2006.01)
*G03G 15/00* (2006.01)

(52) U.S. Cl.

CPC ..... *G03G 15/0152* (2013.01); *G03G 15/0168* (2013.01); *G03G 15/50* (2013.01); *G03G 15/5008* (2013.01); *G03G 15/55* (2013.01)

(58) Field of Classification Search

USPC ..... 399/54, 85
See application file for complete search history.

(56) References Cited

U.S. PATENT DOCUMENTS

| | | | | |
|---|---|---|---|---|
| 6,317,218 | B1 * | 11/2001 | Yorkey et al. | 358/1.13 |
| 6,865,355 | B2 * | 3/2005 | Burkes et al. | 399/85 |
| 7,620,353 | B2 * | 11/2009 | Kwak | 399/302 |
| 7,664,420 | B2 * | 2/2010 | Oominami et al. | 399/85 |
| 2008/0292379 | A1 * | 11/2008 | Tsuchiya | 399/401 |

FOREIGN PATENT DOCUMENTS

| | | | |
|---|---|---|---|
| JP | 2001305818 | A * | 11/2001 |
| KR | 100238037 | | 10/1999 |
| KR | 1020050110224 | | 11/2005 |

* cited by examiner

*Primary Examiner* — Clayton E LaBalle
*Assistant Examiner* — Leon W Rhodes, Jr.
(74) *Attorney, Agent, or Firm* — Staas & Halsey LLP

(57) ABSTRACT

An image forming apparatus to perform mono printing and color printing having different printing speeds and enhance printing performance includes an image forming unit to perform the color printing and the mono printing, and a control unit to determine whether to change a printing speed by comparing an amount of printing to be processed with a predetermined critical value and, if it is determined to change the printing speed, controlling the image forming unit to perform printing according to the amount of printing to be processed by switching a printing speed from printing at a relatively slow printing speed to printing at a relatively fast printing speed.

9 Claims, 6 Drawing Sheets

IMAGE FORMING APPARATUS TO ENHANCE PRINTING PERFORMANCE AND PRINTING METHOD THEREOF

CROSS-REFERENCE TO RELATED APPLICATIONS

This application claims priority under 35 USC §119 from Korean Patent Application No. 10-2011-0103050, filed on Oct. 10, 2011, in the Korean Intellectual Property Office, the disclosure of which is incorporated herein in its entirety by reference.

BACKGROUND

1. Field of the General Inventive Concept

The present general inventive concept relates to an image forming apparatus, and more particularly, to an image forming apparatus to enhance printing performance to reduce a total printing time by selecting a printing speed according to a remaining printing amount during switching between mono printing and color printing when a printing speed is different between the mono printing and the color printing, and a printing method of the image forming apparatus.

2. Description of the Related Art

Image forming apparatuses form an image on a recording medium based on printing data. An image forming apparatus capable of forming a color image forms an electrostatic latent image by scanning light onto a photoconductor body that is charged to a predetermined electric potential. The electrostatic latent image is coated with a developer of a predetermined color. A coated electrostatic latent image is transferred and fused to a recording medium so that a color image is formed.

An image forming apparatus capable of forming a color image may include a single-pass type image forming apparatus provided with a plurality of light scanning units (LSUs) and photoconductors corresponding to multiple colors and a multi-pass type image forming apparatus provided with one LSU and one photoconductor corresponding to multiple colors.

In a conventional multi-pass type image forming apparatus, a single LSU scans light beams corresponding to multiple colors, that is, yellow (Y), magenta (M), cyan (C), and black (K), onto a photoconductor. Images formed on the photoconductor are sequentially transferred to an intermediary transfer medium.

A recording medium is picked up by a pickup roller before all images are transferred to the intermediary transfer medium. The images transferred to the intermediary transfer medium are transferred to a recording medium by a transfer roller. The images transferred to the recording medium are fused by a fusing roller and thus image forming is completed.

However, for mono printing in a multi-pass type image forming apparatus, only black color is scanned onto a photoconductor. When an image formed on the photoconductor is transferred to the recording medium via the intermediary transfer medium, the image is printed in a manner like a single-pass type unlike color printing.

When a printing speed in an image forming apparatus is different between mono printing and color printing, if mono printing is switched to color printing or vice versa, a preliminary operation to change the printing speed is necessarily performed. That is, when the printing speed is different between mono printing and color printing, a predetermined time is used to set an LSU motor clock and a main motor clock suitable for each printing speed whenever mono printing is switched to color printing or vice versa.

As such, when the printing speed in an image forming apparatus is different between mono printing and color printing, for a printing job in which switching between mono printing and color printing frequently occurs, a considerable time may be used for printing due to an intermediary operation according to the switching between the mono printing and color printing.

To reduce the unnecessary time used during printing, when printing with a relatively slow printing speed is switched to printing with a relatively fast printing speed, printing may be performed at the previous slower printing speed without performing an operation to change the printing speed. However, when an amount of printing that is performed without increasing the printing speed is larger than a predetermined number of print sheets, it may be advantageous for the total printing time to change the printing speed to the faster printing speed.

SUMMARY OF THE INVENTION

The present general inventive concept provides an image forming apparatus to enhance printing performance which may reduce a printing time by selecting a printing speed according to a remaining printing amount during switching between mono printing and color printing in order to reduce an intermediary operation performing time used to change a motor clock, for example, when a printing speed is different between mono printing and color printing.

The present general inventive concept provides a printing method of an image forming apparatus which may reduce a printing time by selecting a printing speed according to a remaining printing amount during switching between mono printing and color printing in order to reduce an intermediary operation performing time used to change a motor clock, for example, when a printing speed is different between mono printing and color printing.

Additional features and utilities of the present general inventive concept will be set forth in part in the description which follows and, in part, will be obvious from the description, or may be learned by practice of the general inventive concept.

An embodiment of the present general inventive concept may be achieved by providing an image forming apparatus to perform mono printing and color printing having different printing speeds and enhancing printing performance includes an image forming unit performing the color printing and the mono printing, and a control unit determining whether to change a printing speed by comparing an amount of printing to be processed with a predetermined critical value and, if it is determined to change the printing speed, controlling the image forming unit to perform printing according to the amount of printing to be processed by switching a printing speed from printing at a relatively slow printing speed to printing at a relatively fast printing speed.

An embodiment of the present general inventive concept may also be achieved by providing an image forming apparatus to perform mono printing and color printing with different printing speeds includes an image forming unit performing the color printing and the mono printing, and a control unit controlling the image forming apparatus and, if mono printing continues after color printing, determining whether to perform the mono printing at a mono printing speed or a color printing speed according to the number of print sheets for the mono printing.

When mono printing continues after color printing, the control unit may obtain the number of print sheets for the mono printing and controls the image forming apparatus to perform the mono printing at the mono printing speed if the obtained number of print sheets for the mono printing is greater than a predetermined critical value or at the color printing speed if the obtained number of print sheets for the mono printing is equal to or less than the predetermined critical value.

The image forming apparatus may further include a printing type selection unit that obtains and compares a printing time for the mono printing continuing after the color printing at the mono printing speed and a printing time for the mono printing at the color printing speed and selects any one of the printing speeds consuming a relatively less total printing time, wherein the control unit controls the image forming unit to perform the mono printing at the printing speed selected by the printing type selection unit and consuming a relatively less total printing time.

The selection of a printing speed may be made when information about an image to be printed is analyzed.

The color printing may be performed by a multi-pass method.

An embodiment of the present general inventive concept may also be achieved by providing an image forming apparatus to perform mono printing and color printing with different printing speeds includes an image forming unit performing the color printing and the mono printing, and a control unit controlling the image forming apparatus such that, if mono printing continues after color printing, the image forming apparatus performs the mono printing at a color printing speed. The mono printing may be processed at the color printing speed without switching the printing speed to the mono printing speed.

An embodiment of the present general inventive concept may also be achieved by providing an image forming apparatus to perform mono printing and color printing with different printing speeds includes an image forming unit performing the color printing and the mono printing, and a control unit controlling the image forming apparatus and, if mono printing and color printing continue after color printing, determining whether to perform the mono printing at a mono printing speed or a color printing speed according to an amount of the mono printing and a time to switch the color printing to the mono printing and then back to the color printing.

When mono printing and color printing continue after color printing, the control unit may detect the number of print sheets for the mono printing and control the image forming apparatus to perform the mono printing at the mono printing speed if the detected number of print sheets for the mono printing is greater than a predetermined critical value or at the color printing speed if the detected number of print sheets for the mono printing is equal to or less than the predetermined critical value, wherein the predetermined critical value is obtained by using the number of print sheets for the mono printing and a switching time from the color printing to the mono printing and then back to the color printing.

The image forming apparatus may further include a printing type selection unit that obtains and compares a sum of a printing time for the mono printing continuing after the color printing at the mono printing speed and a time to switch the mono printing to the color printing, and a printing time for the mono printing at the color printing speed, and selects any one of the printing speeds consuming a relatively less total printing time, wherein the control unit controls the image forming apparatus to perform the printing at the printing speed selected by the printing type selection unit and consuming a relatively less total printing time.

An embodiment of the present general inventive concept may also be achieved by providing a method of performing mono printing and color printing with different printing speeds in an image forming apparatus includes checking whether mono printing continues after color printing, detecting an amount of the mono printing when the mono printing continues after the color printing, and determining whether the mono printing is performed at a mono printing speed or a color printing speed based on the detected amount of the mono printing and performing the mono printing.

The amount of the mono printing may be the number of print sheets for the mono printing and, in the performing of the mono printing, the mono printing may be performed at the mono printing speed if the detected number of print sheets for the mono printing is greater than a predetermined critical value or at the color printing speed if the detected number of print sheets for the mono printing is equal to or less than the predetermined critical value.

In the performing of the mono printing, the mono printing may be performed at a printing speed determined by comparing a printing time for the mono printing continuing after the color printing at the mono printing speed with a printing time for the mono printing at the color printing speed.

The color printing may be performed by a multi-pass method.

An embodiment of the present general inventive concept may also be achieved by providing a method of performing mono printing and color printing with different printing speeds in an image forming apparatus includes checking whether mono printing continues after color printing, and performing the mono printing continuing after the color printing at a color printing speed.

An embodiment of the present general inventive concept may also be achieved by providing a method of performing mono printing and color printing with different printing speeds in an image forming apparatus includes checking whether mono printing and color printing continue after color printing, detecting the number of print sheets for the mono printing when the mono printing and color printing continue after the color printing, and performing the mono printing at a mono printing speed if the detected number of print sheets for the mono printing is greater than a predetermined critical value or at a color printing speed if the detected number of print sheets for the mono printing is equal to or less than the predetermined critical value, wherein the predetermined critical value is obtained by using the number of print sheets for the mono printing and a switching time required to switch from the color printing to the mono printing and then back to the color printing.

An embodiment of the present general inventive concept may also be achieved by providing a method of performing mono printing and color printing with different printing speeds in an image forming apparatus includes checking whether the image forming apparatus continuously performs mono printing and color printing after performing color printing, if color printing does not continues after the mono printing, performing the mono printing by switching a printing speed from a color printing speed to a mono printing speed when the number of print sheets for the mono printing is greater than a first critical value or at a color printing speed when the number of print sheets for the mono printing is equal to or less than the first critical value, if mono printing and color printing continue after the mono printing, performing the mono printing by switching the printing speed from the color printing speed to the mono printing speed when the number of print sheets for the mono printing is greater than a second critical value, and performing the mono printing at the color printing speed when the number of print sheets for the mono printing is equal to or less than the second critical value.

An embodiment of the present general inventive concept may be achieved by providing a computer-readable recording medium having recorded thereon a program to execute any of the above-described methods.

BRIEF DESCRIPTION OF THE DRAWINGS

These and other features and utilities of the present general inventive concept will become apparent and more readily appreciated from the following description of the exemplary embodiments, taken in conjunction with the accompanying drawings in which.

DETAILED DESCRIPTION OF THE PREFERRED EMBODIMENTS

Figure 1:
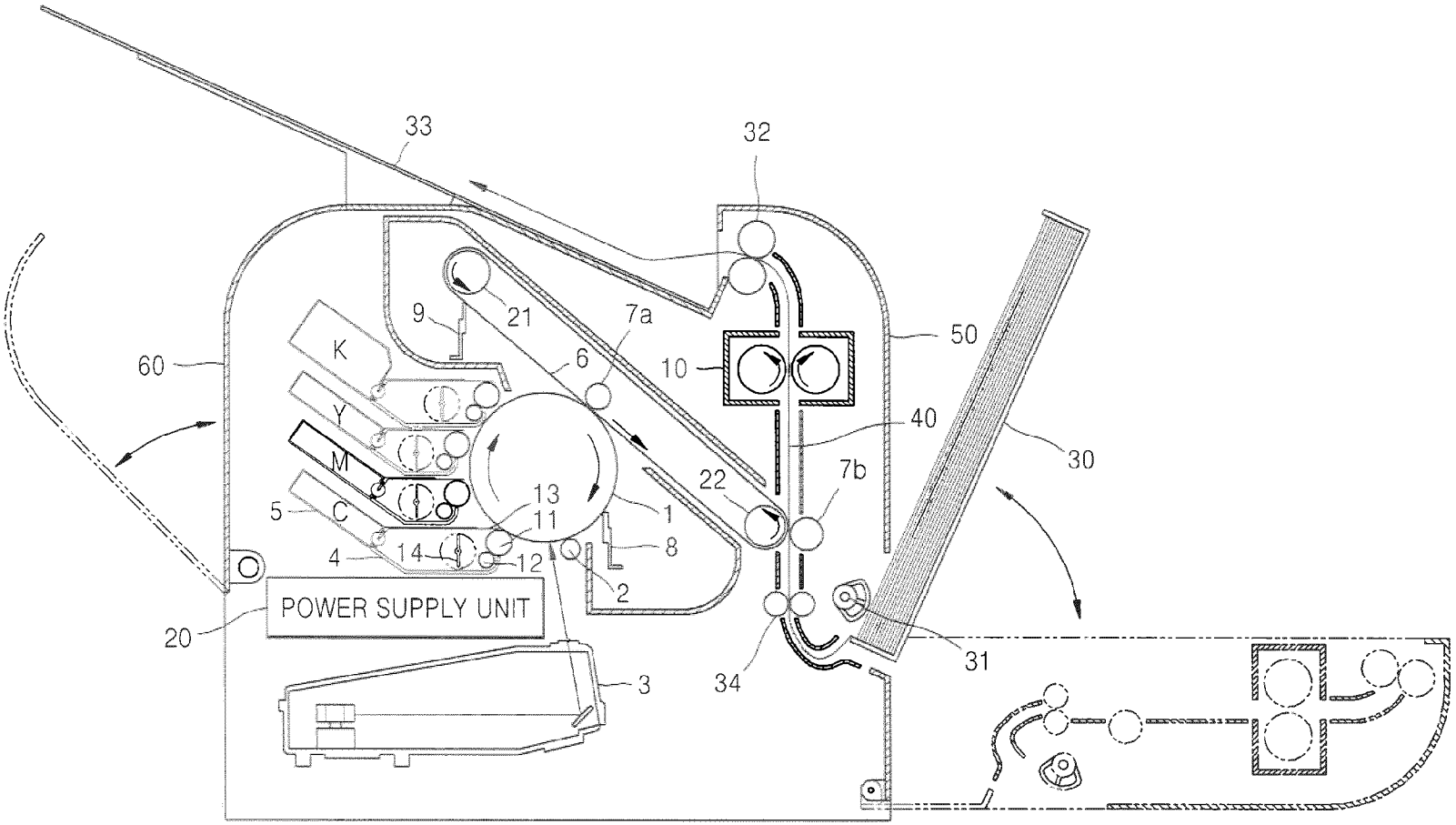
FIG. 1 is a view schematically illustrating an example of a structure of a multi-pass type image forming apparatus, according to an embodiment of the present general inventive concept.

The attached drawings that illustrate exemplary embodiments of the present general inventive concept are referred to in order to gain a sufficient understanding of the present general inventive concept, the merits thereof, and the objectives accomplished by the implementation of the present general inventive concept. Hereinafter, the present general inventive concept will be described in detail by explaining exemplary embodiments of the general inventive concept with reference to the attached drawings. Like reference numerals in the drawings denote like elements.

FIG. 1 is a view schematically illustrating an example of a structure of a multi-pass type image forming apparatus, according to an embodiment of the present general inventive concept. Referring to FIG. 1, a charge roller 2 contacts a photoconductive drum 1. A charge bias is applied to the charge roller 2 to charge a surface of the photoconductive drum 1 to a uniform electric potential. An exposure unit 3 is disposed under the photoconductive drum 1 and scans light modulated according to image information on cyan (C), magenta (M), yellow (Y), and black (K) colors, onto the photoconductive drum 1 to form an electrostatic latent image. A laser scanning unit (LSU) using a laser diode as a light source is mainly used as the exposure unit 3. Four developing units 4C, 4M, 4Y, and 4K are vertically arranged parallel to an outer circumferential surface of the photoconductive drum 1. Toner kits 5 containing toner of cyan (C), magenta (M), yellow (Y), and black (K) colors are respectively coupled to the developing units 4C, 4M, 4Y, and 4K. An intermediary transfer belt 6 is supported by two support rollers 21 and 22 to circulate therearound. A first transfer roller 7*a* makes the intermediary transfer belt 6 contact the photoconductive drum 1 to form a first transfer nip.

In FIG. 1, the image forming apparatus according to the present embodiment includes a cleaning blade 8 to remove toner remaining on the surface of the photoconductive drum 1. Also, the image forming apparatus further includes a developing unit 4, first and second transfer rollers 7*a* and 7*b*, cleaning blades 8 and 9, a fusing unit 10, a developing roller 11, a supply roller 12, a restriction blade 13, an agitator 14, a power supply unit 20, a paper feeding cassette 30, a pickup roller 31, an exhaust roller 32, a tray 33, a transfer roller 34, a transfer path 40, and doors 50 and 60.

Figure 2:
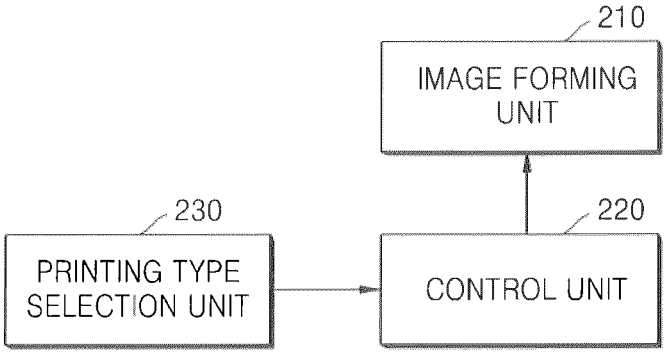
FIG. 2 is a block diagram schematically illustrating a structure of an image forming apparatus to enhance printing performance, according to an embodiment of the present general inventive concept.

FIG. 2 is a block diagram schematically illustrating a structure of an image forming apparatus to enhance printing performance, according to an embodiment of the present general inventive concept. In the image forming apparatus according to the present embodiment, when a printing speed is different between mono printing and color printing and printing with a relatively slow printing speed is switched to printing with a relatively fast printing speed, changing a printing speed is determined through determining a critical value of the number of print sheets and thus a total printing time is reduced regardless of the number of remaining print sheets to be printed, thereby improving printing performance.

The image forming apparatus to enhance printing performance may be configured in a variety of embodiments. The image forming apparatus to enhance printing performance according to the present embodiment includes an image forming unit 210 and a control unit 220. The image forming unit 210 performs color printing and mono printing in an image forming apparatus to perform mono printing and color printing with different processing speeds.

After the image forming apparatus performs a color printing job, a control unit 220 compares the amount of printing yet to be processed with a predetermined critical value and determines whether to change a printing speed. If it is determined that the printing speed needs to be changed, the control unit 220 controls the image forming unit 210 to perform printing according to the printing amount to be processed by switching printing with a relatively slow printing speed to printing with a relatively fast printing speed. For instance, the control unit 220 controls the image forming unit 210 and determines whether to perform mono printing following color printing at a mono printing speed by switching the current color printing speed to the mono printing speed, or at the current color printing speed without changing the printing speed. When the mono printing comes after the color printing, the control unit 220 obtains the number of print sheets as an amount of the mono printing, and controls the image forming unit 210 to perform printing by switching the color printing speed to the mono printing speed if the obtained number of print sheets for mono printing is greater than a predetermined critical value. Otherwise, the mono printing is performed at the color printing speed. The critical value may be determined by using the number of print sheets for mono printing and a time to switch a printing speed from the color printing speed to the mono printing speed.

The image forming apparatus to enhance printing performance according to the present general inventive concept may further include a printing type selection unit 230. The printing type selection unit 230 obtains and compares a printing time to continuously perform mono printing after color printing at a mono printing speed and a printing time to perform the mono printing at a color printing speed, and selects any one of the printing speeds consuming a relatively less total printing time. The control unit 220 controls the image forming unit 210 so that a print job may be performed at the printing speed selected by the printing type selection unit 230 and consuming a relatively less total printing time.

The selection of a printing speed may be performed when image information to be printed is analyzed. The image forming apparatus according to the present general inventive concept may be a multi-pass type image forming apparatus.

According to another embodiment of the present general inventive concept, an image forming apparatus to enhance printing performance may also include the image forming unit 210 and the control unit 220. The image forming unit 210 performs color printing and mono printing in the image forming apparatus performing the mono printing and color printing having different printing speeds. In the present embodiment, when mono printing continues after color printing, the control unit 220 controls the image forming unit 210 to perform the mono printing to be processed at the color printing speed without switching the printing speed to the mono printing speed. Thus, according to the present embodiment, when the number of print sheets for mono printing is not many, a time to switch a printing speed may be saved.

According to further another embodiment of the present general inventive concept, an image forming apparatus to enhance printing performance may also include the image forming unit 210 and the control unit 220. The image forming unit 210 performs color printing and mono printing in the image forming apparatus performing the mono printing and color printing having different printing speeds. In the present embodiment, when mono printing and color printing continue after color printing, the control unit 220 controls the image forming unit 210 and determines whether to perform the mono printing at a mono printing speed or a color printing speed based on the time required to switch from the color printing to the mono printing and then to the color printing and based on the amount of the mono printing.

When the mono printing and the color printing is continuously performed after the color printing, the control unit 220 detects the number of print sheets for the mono printing and controls the image forming unit 210 to perform the mono printing at a mono printing speed when the number of print sheets for the mono printing is greater than a predetermined critical value or at a color printing speed when the number of print sheets for the mono printing is equal to or less than the predetermined critical value. The critical value may be obtained by using the number of print sheets for the mono printing and the time required to switch a printing speed from the color printing speed to the mono printing speed and then back to the color printing speed.

According to further another embodiment of the present general inventive concept, an image forming apparatus to enhance printing performance may further include the printing type selection unit 230 in addition to the image forming unit 210 and the control unit 220. When mono printing continues after color printing, the printing type selection unit 230 obtains and compares a sum of a printing time to continuously perform the mono printing after the color printing at a mono printing speed and a time to switch the mono printing to the color printing, with a time to perform the mono printing at a color printing speed, and selects any one of the printing speeds consuming a relatively less total printing time. Then, the control unit 220 controls the image forming unit 210 so that a print job may be performed at the printing speed selected by the printing type selection unit 230 and consuming a relatively less total printing time.

In the above-described embodiments, the time to switch the printing speed may generally include a time to change rotational speeds of an LSU motor and a main motor and a time to stabilize the LSU motor and the main motor.

A printing method of an image forming apparatus to enhance printing performance according to the present general inventive concept will be described below.

Figure 3:
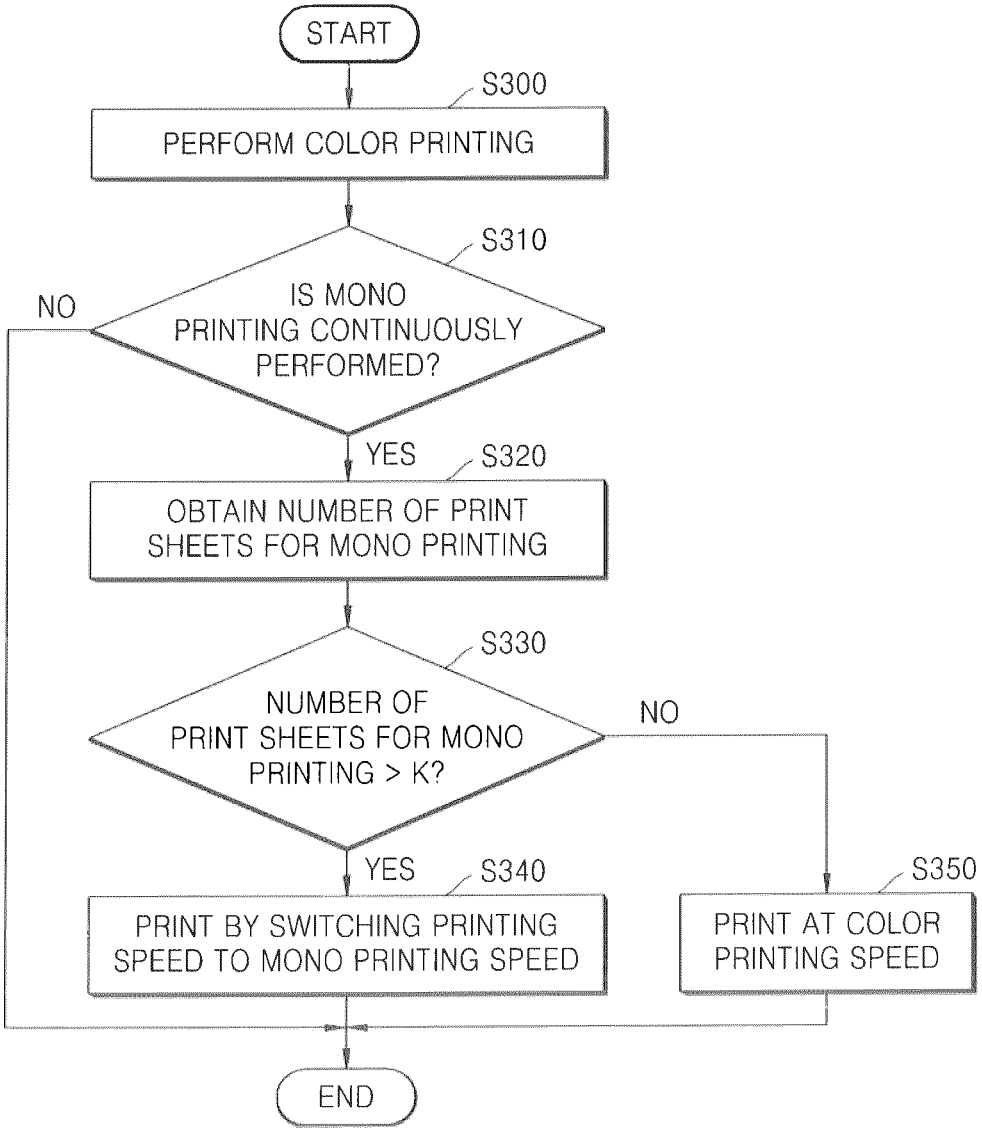
FIG. 3 is a flowchart illustrating a printing method of an image forming apparatus to enhance printing performance, according to an embodiment of the present general inventive concept.

FIG. 3 is a flowchart illustrating a printing method of an image forming apparatus to enhance printing performance, according to an embodiment of the present general inventive concept. Referring to FIG. 3, the image forming apparatus to perform mono printing and color printing having different printing speeds checks whether mono printing is continuously performed after color printing (operation S300). If it is determined that mono printing continues after color printing, the image forming apparatus obtains an amount of mono printing (operation S320). The amount of mono printing may be the number of print sheets for mono printing. It is determined whether mono printing is performed at a mono printing speed or a color printing speed based on the obtained amount of print sheets needed for mono printing and then printing is performed accordingly. For example, when the detected number of print sheets needed for mono printing is greater than a predetermined critical value K (operation S330), the image forming unit 210 switches a printing speed to a mono printing speed under the control of the control unit 220 and performs printing. When the number of print sheets for mono printing is equal to or less than the critical value K, the image forming unit 210 performs mono printing at a color printing speed without switching the printing speed of the mono printing (operation S350).

Figure 4:
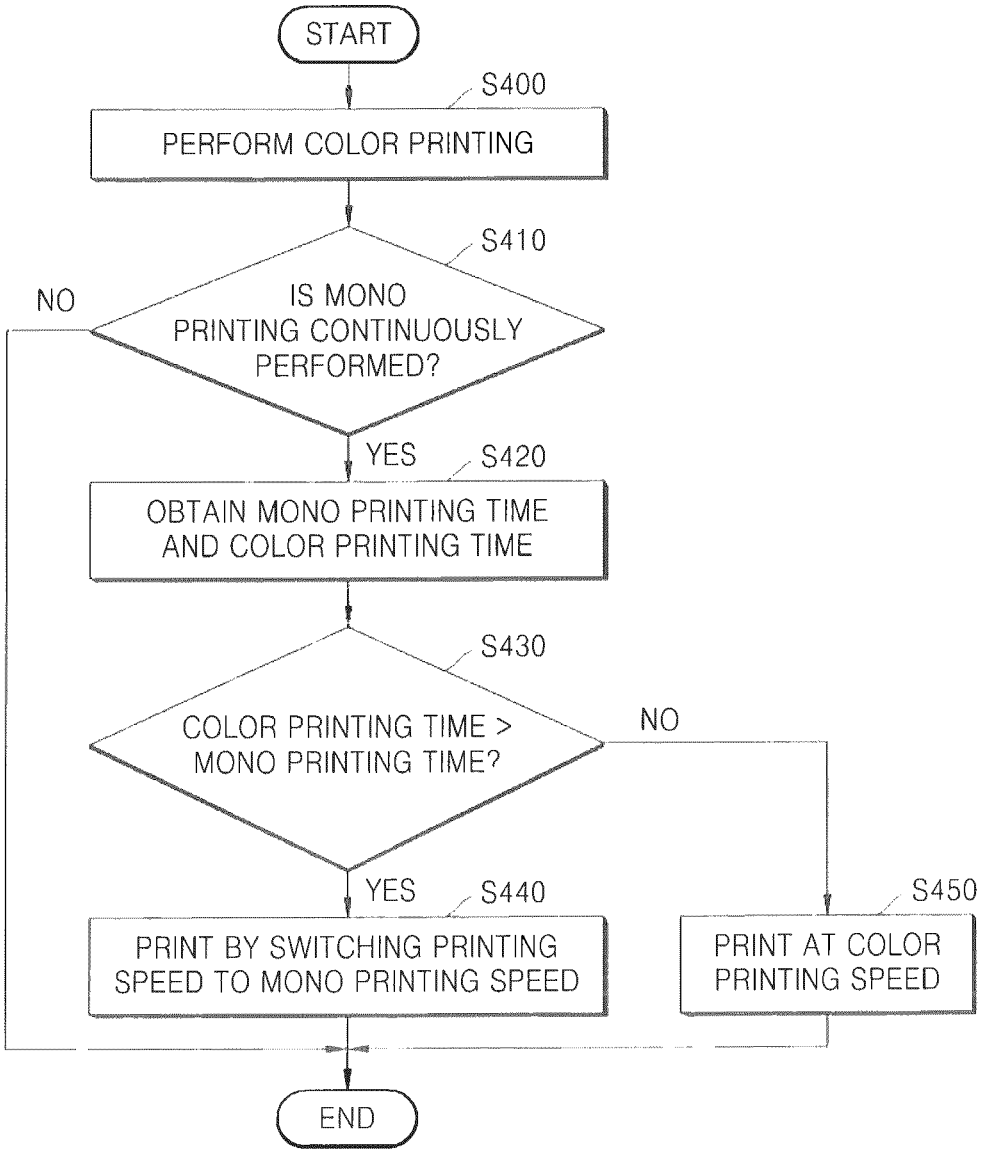
FIG. 4 is a flowchart illustrating a printing method of an image forming apparatus to enhance printing performance, according to another embodiment of the present general inventive concept.

FIG. 4 is a flowchart illustrating a printing method of an image forming apparatus to enhance printing performance, according to another embodiment of the present general inventive concept. Referring to FIG. 4, the image forming apparatus to perform mono printing and color printing having different printing speeds checks whether mono printing is continuously performed after color printing (operations S400 and S410). Then, the image forming unit obtains a time to perform the mono printing that continues after the color printing at a mono printing speed and a time to perform the mono printing at a color printing speed (operation S420). The control unit 220 compares the time to perform the mono printing at the mono printing speed and the time to perform the mono printing at the color printing speed (operation S430). If the mono printing at the color printing speed is greater than that at the mono printing speed, the image forming unit 210 under the control of the control unit 210 switches the printing speed to the mono printing speed and performs the mono printing (operation S440). Otherwise, the mono printing is performed at the color printing speed (operation S450). The print job may be performed in a multi-pass type method.

In a printing method of an image forming apparatus to enhance printing performance according to further another embodiment of the present general inventive concept, it is checked whether mono printing continues after color printing and, if the mono printing continues after the color printing, the mono printing may be performed at a color printing speed.

Figure 5:
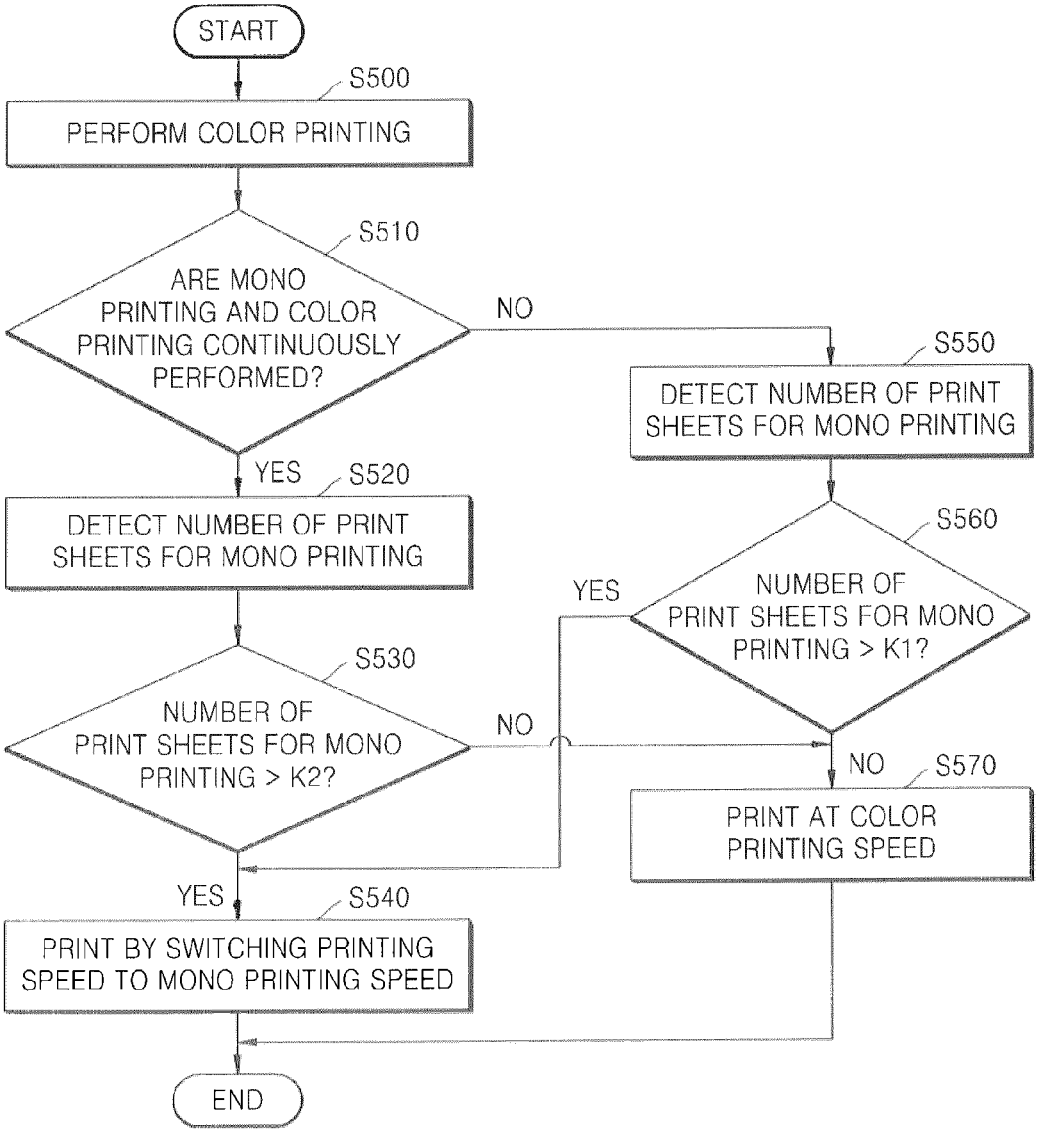
FIG. 5 is a flowchart illustrating a printing method of an image forming apparatus to enhance printing performance, according to another embodiment of the present general inventive concept.

FIG. 5 is a flowchart illustrating a printing method of an image forming apparatus to enhance printing performance, according to further another embodiment of the present general inventive concept. Referring to FIG. 5, the image forming apparatus performing mono printing and color printing with different printing speeds checks whether mono printing and color printing are continuously performed after color printing (operation S500).

When it is checked that mono printing and color printing are continuously performed after color printing, the control unit 220 detects the number of print sheets for mono printing (operation S520). If the detected number of print sheets for mono printing is greater than a second critical value K2 (operation S530), the image forming unit 210 switches the printing speed to the mono printing speed and performs the mono printing at the mono printing speed (operation S540). If the detected number of print sheets for mono printing is equal to or less than the second critical value K2 (operation S530), the image forming unit 210 performs the mono printing at the color printing speed (operation S570). The critical value may be determined by using the number of print sheets for mono printing and the time to change a printing speed from the color printing speed to the mono printing speed and then back to the color printing speed.

In the operation S510, after checking whether the image forming apparatus continuously performs mono printing and color printing after performing color printing, the control unit 220 detects the number of print sheets for mono printing when color printing does not continue after the mono printing (operation S550). When the number of print sheets for mono printing is greater than a first critical value K1 (operation S560), the image forming unit 210 under the control of the control unit 220 switches the printing speed from the color printing speed to the mono printing speed and performs the mono printing at the mono printing speed (operation S540). When the number of print sheets for mono printing is equal to or less than the first critical value K1 (operation S560), the image forming unit 210 performs the mono printing at the color printing speed (operation S570).

According to the present general inventive concept, when a color printing speed and a mono printing speed are different from each other and printing with a relatively slow processing speed is switched to printing with a relatively fast processing speed, whether to switch the printing speed is determined through comparison between the number of print sheets to be processed through switching with a critical number of print sheets, and then, remaining printing is processed. Thus, an overall printing time is reduced so that printing performance may be improved.

There is a need to find out a critical value of the number of print sheets used to determine whether to switch a printing speed. To find out a critical value of the number of print sheets, different mathematical equations are used for cases in which only a mono printing job remains or both of mono and color printing jobs remain when a color printing job is switched to a mono printing job. The critical value of the number of print sheets denotes a boundary to select an efficient method between printing the remaining number of print sheets by switching a printing speed or printing the remaining number of print sheets without switching a printing speed.

The critical value of the number of print sheets may be obtained as follows. First, when only a mono printing job remains after a color printing job, the critical value of the number of print sheets may be obtained by using Equation 1. In Equation 1, "$P_1$" denotes a color printing speed, "$P_2$" denotes a mono printing speed, "K" denotes a critical value of the number of print sheets, and "T" denotes a speed switching time.

$$60\frac{K}{P_1} = 60\frac{K}{P_2} + T(P_1 < P_2) \quad \text{[Equation 1]}$$

When two types of printing jobs, that is, mono printing and color printing, remain after a color printing job, the critical value of the number of print sheets may be obtained by using Equation 2. In Equation 1, "$P_1$" denotes a color printing speed, "$P_2$" denotes a mono printing speed, "K" denotes a critical value of the number of print sheets, and "T" denotes a speed switching time.

$$60\frac{K}{P_1} = 60\frac{K}{P_2} + 2T(P_1 < P_2) \quad \text{[Equation 2]}$$

To summarize Equations 1 and 2, the critical value of the number of print sheets when only a mono printing job remains after a color printing job may be expressed by Equation 3.

$$K = \frac{TP_1P_2}{60(P_2 - P_1)} \quad \text{[Equation 3]}$$

The critical value of the number of print sheets when the two types of printing jobs, that is, mono printing and color printing, remain after a color printing job may be expressed by Equation 4.

$$K = \frac{2TP_1P_2}{60(P_2 - P_1)} \quad \text{[Equation 4]}$$

Figure 6:
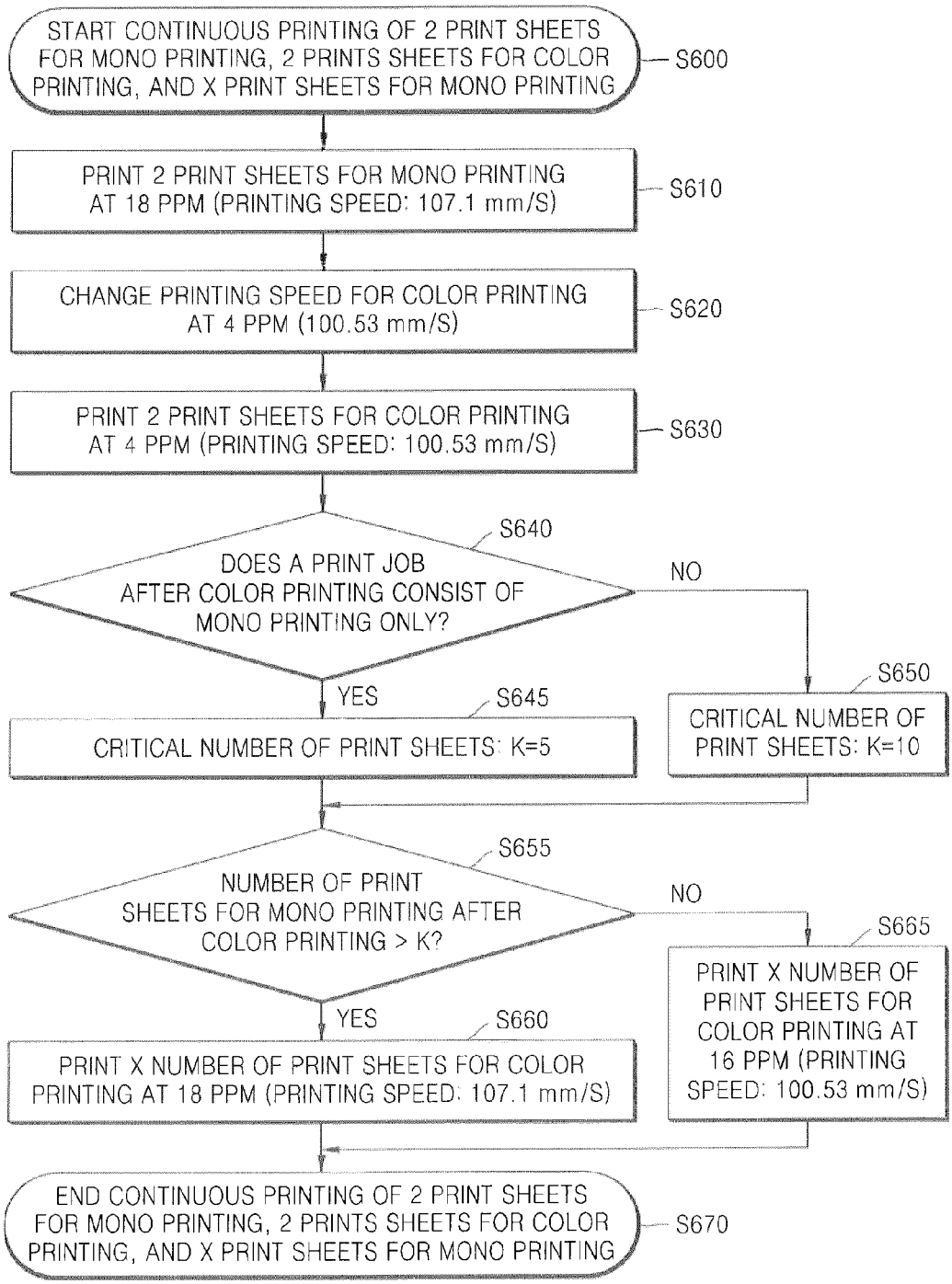
FIG. 6 is a flowchart illustrating a printing method of an image forming apparatus to enhance printing performance, according to further another embodiment of the present general inventive concept.

FIG. 6 is a flowchart illustrating a printing method of an image forming apparatus to enhance printing performance, according to further another embodiment of the present general inventive concept. FIG. 6 illustrates a printing method of an image forming apparatus according to the present general inventive concept under the following conditions. It is assumed that color printing is 4 ppm (mono printing P1=16 ppm and a mono printing speed is 100.53 mm/S), mono printing P2=18 ppm (a mono printing speed is 107.1 mm/S), and a time required to switch from color printing to mono printing is 2 seconds (T=2 sec). In this situation, the critical value K of print sheets may be obtained by using Equations 3 and 4.

First, when only a mono printing job remains after a color printing job, it can be expressed by Equation 5.

$$K = \frac{2 \cdot 16 \cdot 18}{60(18 - 16)} = 4.8 \cong 5 \quad \text{[Equation 5]}$$

When both of mono printing and color printing remain after a color printing job, it can be expressed by Equation 6.

$$K = \frac{2 \cdot 2 \cdot 16 \cdot 18}{60(18 - 16)} = 9.6 \cong 10 \quad \text{[Equation 6]}$$

The critical value of print sheets is 5 or 10 sheets according to the above-described two cases and whether to switch the printing speed may be determined based on the obtained critical value.

Referring to FIG. 6, it is assumed that 2 print sheets for mono printing, 2 print sheets for color printing, and X print sheets for mono printing are sequentially and continuously printed (operation S600). For the first 2 print sheets for mono printing, mono printing is performed at 18 ppm (a printing speed of 107.1 mm/S) (operation S610). Since the 2 print sheets for color printing performed after the 2 print sheets for mono printing is performed at a printing speed of 100.53 mm/S (color printing of 4 ppm and mono printing of 16 ppm), to reduce a printing speed, an intermediary operation is performed to change the rotation speeds of the LSU motor and the main motor (operation S620). After the LSU motor and the main motor are stabilized in the intermediary operation, the image forming unit 210 prints 2 print sheets for color printing at a print speed of 4 ppm (a printing speed of 100.53 mm/S) (operation S630).

The printing speed of the X print sheets for mono printing varies according to the existence of color printing after the 2 print sheets for color printing is printed and to the amount of X. Although in a conventional technology the next printing is performed by changing a printing speed with no condition, in the present embodiment, when the X print sheets for mono printing is printed after the 2 print sheets for color printing is printed, the control unit 220 checks whether there is color printing continuously after the mono printing (operation S640).

If color printing exists after mono printing, the control unit 220 sets the critical value K of the number of print sheets to 5 (operation S645). Otherwise, the control unit 220 sets the critical value K of the number of print sheets to 10 (operation S650).

Then, whether to change a printing speed is determined by comparing the set critical value K of 5 or 10 with the remaining number X of print sheets for mono printing (operation S655). When the X is equal to or less than the critical value K of the number of print sheets, since the remaining number X of print sheets for mono printing is small, even if a printing speed is increased, an effect may not be great. Accordingly, the printing is processed at a printing speed of 100.53 mm/S (color printing at 16 ppm) that is previously used without changing a printing speed so that the time to print may be saved (operation S665). Contrarily, when the X for mono printing is greater than the critical value K of the number of print sheets, since the remaining number of print sheets is large, a printing speed is increased so that the time to process the remaining number of print sheets may be saved (operation S660). Since the time to process the remaining number of print sheets is greater than the time to change the printing speed, the overall printing time may be saved. As such, the time loss generated when the remaining number of print sheets is greater than the critical number of print sheets when color printing is switched to mono printing in the conventional technology is reduced so that printing performance may be improved.

As described above, in the image forming apparatus according to the present general inventive concept, when a printing speed is different between mono printing and color printing and printing with a relatively slow printing speed is switched to printing with a relatively fast printing speed, changing a printing speed is determined through a critical value of the number of print sheets and thus a total printing time is reduced regardless of the number of remaining print sheets to be printed, thereby enhancing printing performance.

That is, when the number of print sheets to be printed after changing a printing speed is smaller than a critical value, printing is performed without changing the printing speed so that a time to switch the printing speed may be saved and the printing performance may be enhanced.

The general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion.

While this general inventive concept has been particularly illustrated and described with reference to exemplary embodiments thereof, it will be understood by those skilled in the art that various changes in form and details may be made therein without departing from the spirit and scope of the general inventive concept as defined by the appended claims.

What is claimed is:

1. An image forming apparatus to perform mono printing at a mono printing speed and color printing at a color printing speed that is different than the mono printing speed, the image forming apparatus comprising:

an image forming unit performing the color printing and the mono printing; and a control unit controlling the image forming unit, checking whether the image forming apparatus performs only the mono printing after the color printing or consecutively performs the mono printing and the color printing after the color printing, and setting a first critical value K1 of a first number of mono-printed sheets when performing only the mono printing and differently setting a second critical value K2 of a second number of mono-printed sheets when consecutively performing the mono printing and the color printing so as to determine one of a mono printing speed and a color printing speed, wherein the control unit determines whether to change a printing speed by comparing an amount of printing to be processed using the first critical value K1 and the second critical value K2 that are differently set and, if it is determined to change the printing speed, the controller controls the image forming unit to perform printing according to the amount of the printing to be processed by switching the printing speed from printing at the color printing speed to printing at the mono printing speed.

2. The image forming apparatus of claim 1, wherein, when performing only the mono printing after the color printing, the controller controls the image forming unit to perform the mono printing after changing the printing speed from the color printing speed to the mono printing speed if a number of mono-printed sheets is greater than the first critical value K1 and controls the image forming unit to perform the mono printing at the color printing speed if the number of mono-printed sheets is not greater than the first critical value K1, and, when the image forming apparatus consecutively performs the mono printing and the color printing after performing the color printing, the controller controls the image forming unit to perform the mono printing after changing the color printing speed to the mono printing speed if the number of mono-printed sheets is greater than the second critical value K2, and controls the image forming unit to perform the mono printing at the color printing speed if the number of mono-printed sheets is not greater than the second critical value K2.

3. The image forming apparatus of claim 1, wherein the first critical value K1 and the second critical value K2 are determined by a color printing speed P1, a mono printing speed P2, and a time T which is needed in conversion between the color printing speed and the mono printing speed, and second critical value K2 is greater than first critical value K1.

4. The image forming apparatus of claim 3, wherein the time T, which is needed in conversion between the color printing speed and the mono printing speed, includes a time to change a rotational speed of a laser scanning unit (LSU) motor, a time to change a rotational speed of a main motor, a time to stabilize the LSU motor, and a time to stabilize the main motor.

5. The image forming apparatus of claim 2, wherein the printing job is performed by a multi-pass method.

6. A printing method of an image forming apparatus including a mono printing at a mono printing speed and a color printing at a color printing speed that is different than the mono printing speed, the printing method comprising:

checking whether the image forming apparatus performs only the mono printing after the color printing or consecutively performs the mono printing and the color printing after the color printing;

setting a first critical value K1 of a first number of mono-printed sheets when performing only the mono printing and differently setting a second critical value K2 of a second number of mono-printed sheets when consecutively performing the mono printing and the color printing;

when performing only the mono printing after the color printing, performing the mono printing after changing the printing speed from the color printing speed to the mono printing speed if a number of mono-printed sheets is greater than the first critical value K1, and performing the mono printing at the color printing speed if the number of mono-printed sheets is not greater than the first critical value K1; and when the image forming apparatus consecutively performs the mono printing and the color printing after performing the color printing, performing the mono printing after changing the color printing speed to the mono printing speed if the number of mono-printed sheets is greater than the second critical value K2, and performing the mono printing at the color printing speed if the number of mono-printed sheets is not greater than the second critical value K2.

7. The printing method of claim 6, wherein the first critical value K1 and the second critical value K2 are determined by a color printing speed P1, a mono printing speed P2, and a time T which is needed in conversion between the color printing speed and the mono printing speed, and the second critical value K2 is greater than the first critical value K1.

8. The printing method of claim 7, wherein the time T, which is needed in conversion between the color printing speed and the mono printing speed, includes a time to change a rotational speed of a laser scanning unit (LSU) motor, a time to change a rotational speed of a main motor, a time to stabilize the LSU motor, and a time to stabilize the main motor.

9. The printing method of claim 7, wherein the printing job is performed by a multi-pass method.

* * * * *